US010343841B1

(12) United States Patent
Dixon et al.

(10) Patent No.: US 10,343,841 B1
(45) Date of Patent: Jul. 9, 2019

(54) WASTE CONTAINMENT AND ISOLATING SYSTEM AND METHOD OF ISOLATING WASTE THEREOF

(71) Applicants: Richard Kyle Dixon, Fulshear, TX (US); Scott Edward Parazynski, Houston, TX (US)

(72) Inventors: Richard Kyle Dixon, Fulshear, TX (US); Scott Edward Parazynski, Houston, TX (US)

( * ) Notice: Subject to any disclaimer, the term of this patent is extended or adjusted under 35 U.S.C. 154(b) by 0 days.

(21) Appl. No.: 16/132,386

(22) Filed: Sep. 15, 2018

(51) Int. Cl.
*B65F 1/00* (2006.01)
*B65D 55/08* (2006.01)
*B65D 30/00* (2006.01)

(52) U.S. Cl.
CPC ..... *B65F 1/0026* (2013.01); *B65D 55/08* (2013.01); *B65F 1/002* (2013.01); *B65D 29/00* (2013.01)

(58) Field of Classification Search
CPC ..... B65D 55/08; B65D 29/00; B65F 1/0026; B65F 1/002
USPC ..... 220/495.11
See application file for complete search history.

(56) References Cited

U.S. PATENT DOCUMENTS 5,135,222 A * 8/1992 Spector ..... A63B 41/02 150/106
5,988,879 A * 11/1999 Bredderman ..... A45C 3/00 150/112
7,988,681 B2 8/2011 McGarity et al.
8,801,286 B2 8/2014 Tatsuno
9,296,524 B2 3/2016 Woloveck et al.

* cited by examiner

*Primary Examiner* — King M Chu
(74) *Attorney, Agent, or Firm* — Steven H Greenfield; Greenfield Invention and Patent Consulting Inc.

(57) ABSTRACT

A waste containment and isolating system used for storing and isolating waste materials in a way that closure of the device and isolating the waste is done remotely and in a way that the user does not need to come in contact with the waste or the containment device is disclosed. The device comprises of a bag containing a drawstring threaded through the center of a flexible tab that is wedged in a fixed position such that pulling on the drawstring portion behind the tab draws in the bag opening into a closed mouth, drawing the closed mouth toward the tab and flexing the tab onto the closed mouth to seal it and prevent odiferous gasses from leaking out.

4 Claims, 4 Drawing Sheets

WASTE CONTAINMENT AND ISOLATING SYSTEM AND METHOD OF ISOLATING WASTE THEREOF

FIELD OF THE INVENTION

The present invention relates to a waste containment and isolating system that may be used for storing and isolating waste materials in such a way that closure of the device and isolating the waste is done remotely and in such a way that the user does not need to come in contact with the waste or the containment device. The waste materials may be in solid form, liquid form or a combination of both. The present invention also relates to a method for containing and isolating waste materials accomplished in such a way that the user does not need to come in contact with the waste or the containment device.

The types of waste materials collected and stored in the containment device may include but are not limited to animal feces and hazardous materials such as samples of nuclear, biological, chemical, medical or other odiferous waste products.

BACKGROUND OF THE INVENTION

There are numerous containment devices taught in prior art references for waste materials. U.S. Pat. No. 7,988,681 B2 relates to a portable waste containment device that is rapidly deployable. The waste containment device allows containment of liquid or semi-liquid waste until permanently disposed. It also provides a portable waste containment system wherein the waste containment device is enclosed within a package for storage and when pulled from the package the waste containment device is ready for use. The disclosure also provides a method of using the portable waste containment device. U.S. Pat. No. 8,801,286 B2 is for a storage bag that can maintain compactness into which an object can be easily inserted and stored, and whose shape can be changed after the object is stored in the storage bag. A storage bag including a cylindrical body and a bottom at one end of the body, wherein the bottom closes one end of the body, the other open end of the body is formed as a storage opening, and the inside space of the storage bag is formed as a storage space capable of storing an object. U.S. Pat. No. 9,296,524 B2 teaches a child-resistant packaging comprising a packaging container having a mouth and a drawstring positioned along the mouth for selectively opening and closing the mouth. A first cord lock is adapted to receive first and second ends of the draw string. Actuation of the first cord lock enables the first cord lock to slidably engage the drawstring.

Storing and isolating any hazardous waste in the containment device requires two steps: 1) collecting, transporting and depositing the waste inside the containment device through an opening in the containment and 2) closing the opening to prevent odors, potentially toxic gases or biohazardous germs from being released from the device. For both steps, it is often desirable to prevent bodily contact with the waste as well as with the containment device especially for highly toxic materials that may produce ill effects for the user. Thus, it would be desirable to have a containment device configured for enabling the user to close the opening as well as dispose of the containment device remotely and without coming in bodily contact with it after the waste is deposited inside.

SUMMARY OF THE PRESENT INVENTION

In one aspect of the present invention, a containment device for isolating waste comprises: a flexible bag having an opening; a drawstring having a first end and a second end, the drawstring looping inside a channel formed around the opening of the flexible bag; and a tab having an inner surface, an outer surface and a center opening through which the first end and the second end of the drawstring are threaded, the first end of the drawstring being joined with the second end of the drawstring wherein an attachment formed by joining the first end of the drawstring with the second end of the drawstring is disposed behind the outer surface of the tab, the tab being configured for sliding on the drawstring in a direction toward the flexible bag and away from the flexible bag, wherein the opening of the flexible bag being configured for substantially contracting into a closed position and forming a closed mouth upon outwardly extending the drawstring while holding the tab is in a fixed position, the tab being adapted for flexing onto and sealing the closed mouth.

In another aspect of the present invention, a method for isolating waste comprises; providing a flexible bag having an opening; a drawstring having a first end and a second end, the drawstring looping inside a channel formed around the opening; and a tab having an inner surface, an outer surface and a center opening through which the first end and the second end of the drawstring are threaded, the first end of the drawstring being joined with the second end of the drawstring wherein a combined end formed by joining the first end of the drawstring with the second end of the drawstring is disposed behind the outer surface of the tab, the tab being configured for sliding on the drawstring in a direction toward the flexible bag and away from the flexible bag; providing a container, the container being held in a fixed position, the container comprising an inside, an open top and a slotted pocket attached to the container; wedging the tab into the slotted pocket attached to the container such that the combined end of the drawstring is accessible through a groove in a rear of the slotted pocket and such that the tab is immobile; stretching the opening of the flexible bag over the open top of the container and lining the flexible bag on the inside of the container; placing waste that requires disposal inside the flexible bag; pulling on the combined end of the drawstring away from the container and flexible bag, the pulling simultaneously causing the opening of the flexible bag to a) be removed off the open top of the container, b) to contract and form a closed mouth and c) to move the closed mouth toward the tab causing the tab to seal the closed mouth; and removing the drawstring and tab from the groove in a rear of the slotted pocket and removing the bag.

These and other features, aspects and advantages of the present invention will become better understood with reference to the following drawings, description and claims.

DETAILED DESCRIPTION OF THE INVENTION

The following detailed description is of the best currently contemplated modes of carrying out exemplary embodiments of the invention. The description is not to be taken in a limiting sense, but is made merely for the purpose of illustrating the general principles of the invention.

Figure 1:
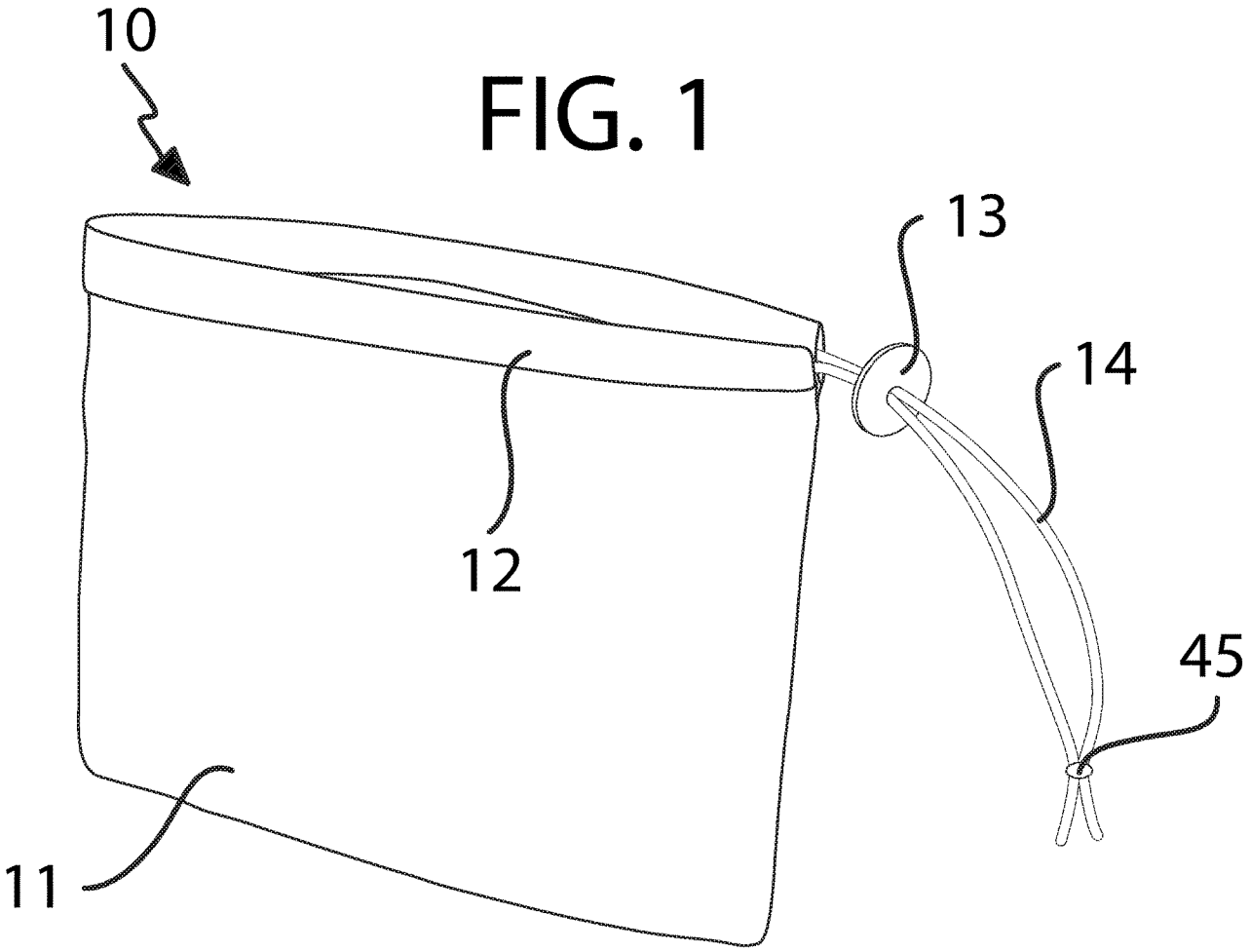
FIG. 1 shows a side perspective view of the waste storage and isolating system according to an embodiment of the present invention.
Figure 3:
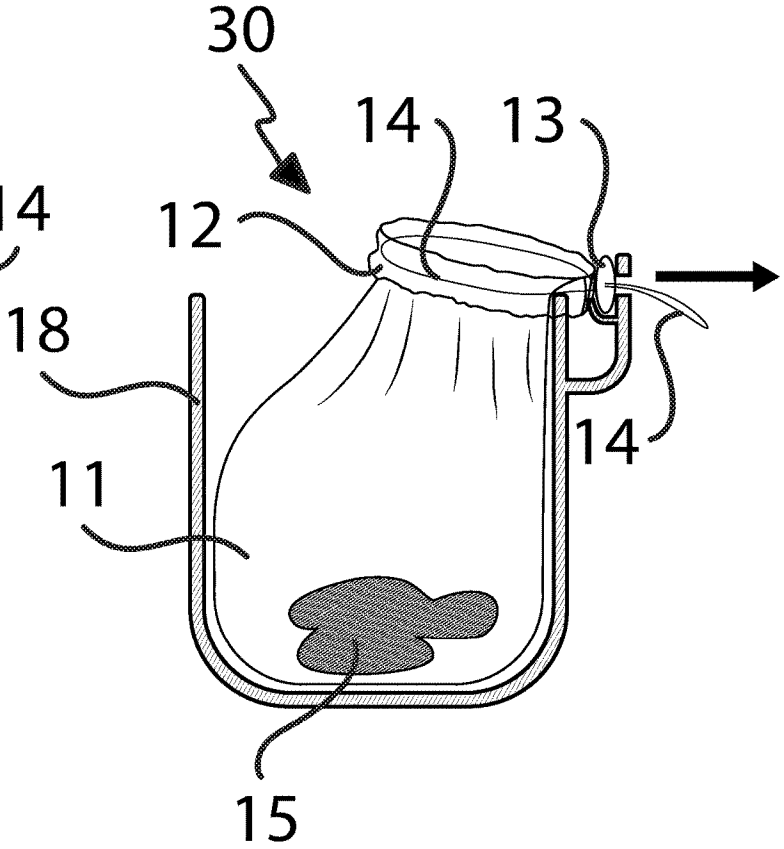
FIG. 3 illustrates a first step for closing the waste storage and isolating system in a manner that the user does not come in contact with the bag.

The waste storage and isolating system 10 of the present invention comprises a flexible bag 11 that may be made from a variety of materials including but not limited to plastic, woven, and non-woven fabric, paper and combinations thereof. The material of construction preferably has low permeability to minimize any leaching of hazardous or odiferous materials out of the bag 11. The bag 11 has a top opening which contains a channel 12 around the top opening through which a drawstring 14 is threaded. The two ends of the drawstring 14 that exit from the channel 12 are threaded through the center of a tab 13 and the two ends of the drawstring 14 are attached to one another after they exit the tab 13 at attachment point 45. The waste storage and isolating system 10 is shown in FIG. 1.

Figure 2:
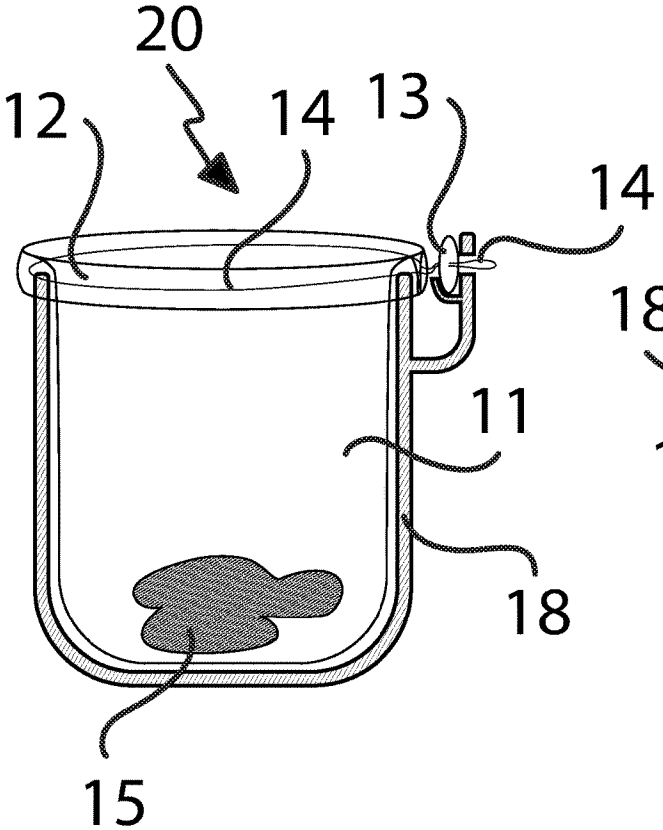
FIG. 2 is a cross sectional view of an open waste storage and isolating system with waste stored inside it according to an embodiment of the present invention.

FIG. 2 shows a setup 20 that would be used to isolate and remove waste stored in the bag 11 in a manner that the user avoids contact with the waste or the bag 11. The opening of the bag 11 is stretched over the open top of a solid container 18 and the bag 11 lines the inside of the solid container 18. The solid container 18 comprises a side pocket 17 attached to the side of the solid container 18 in which the tab 13 is wedged such that the tab 13 is rendered immobile. The drawstring 14 exiting the tab 13 is accessible to the user through a groove located in the back of the side pocket 17. Placing any hazardous waste 15 inside the bag 11 may be done in a number of ways but generally involve equipment such as shovels or robotic arms that aid in carrying the waste 15 and remotely placing it in the bag 11.

Figure 5:
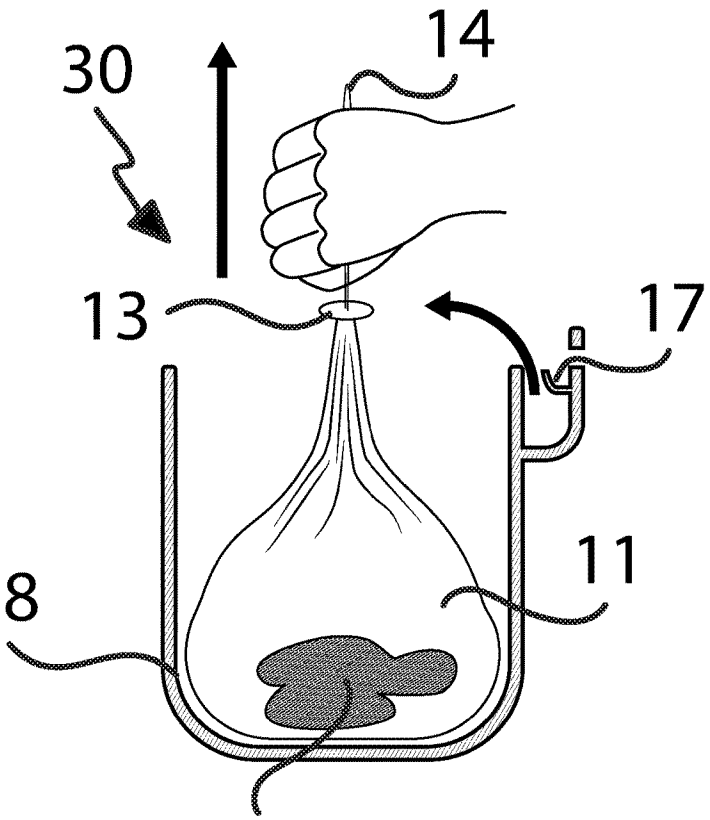
FIG. 5 illustrates a third step for closing the waste storage and isolating system in a manner that the user does not come in contact with the bag.
Figure 4:
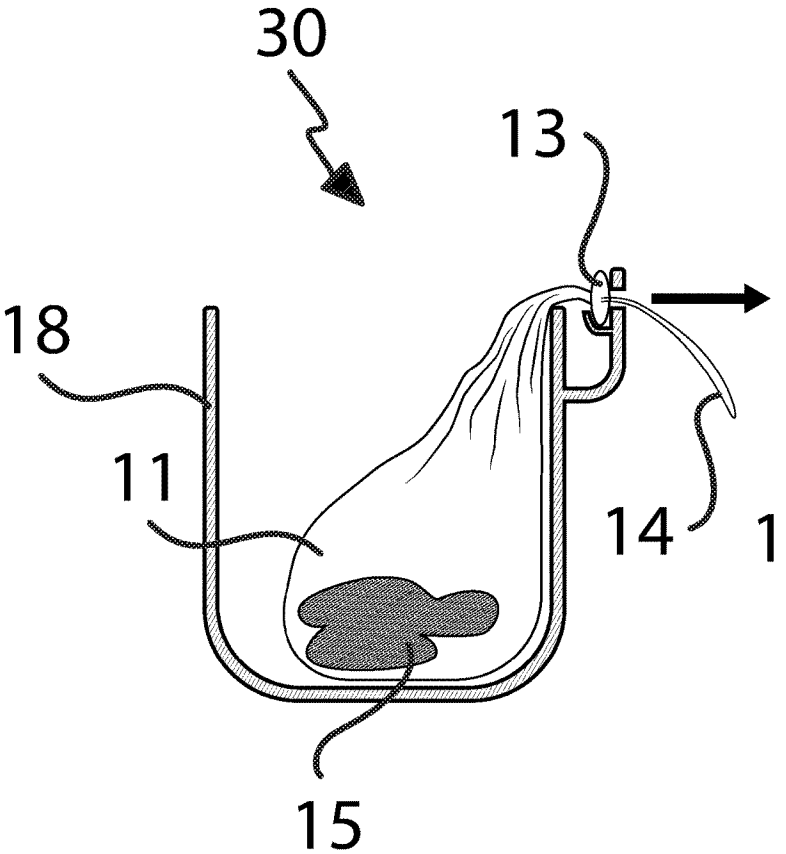
FIG. 4 illustrates a second step for closing the waste storage and isolating system in a manner that the user does not come in contact with the bag.
Figures 6, 7:
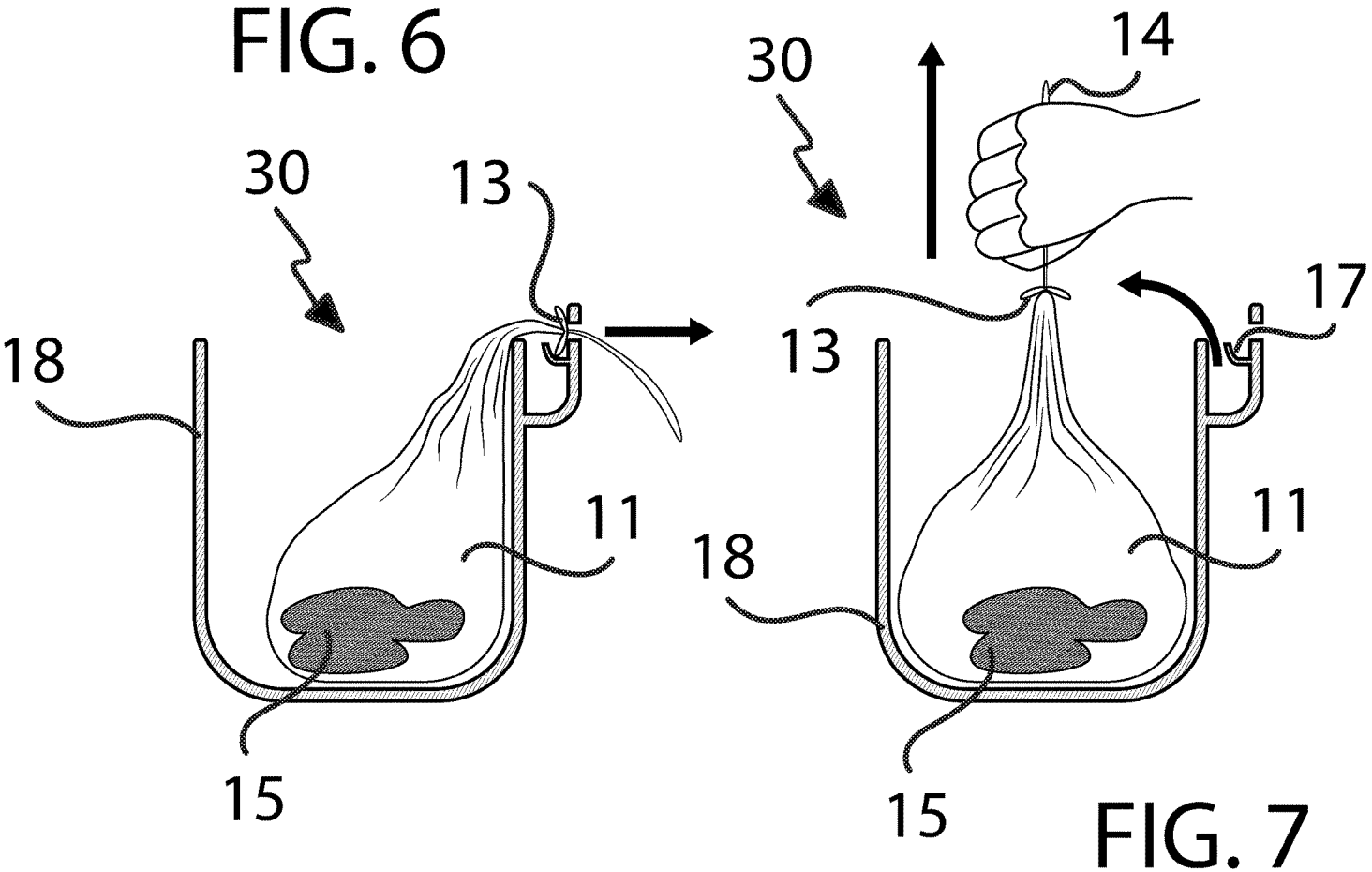
FIG. 6 illustrates a fourth step for closing the waste storage and isolating system in a manner that the user does not come in contact with the bag.
FIG. 7 illustrates a fifth step for closing the waste storage and isolating system in a manner that the user does not come in contact with the bag.

The steps 30 for the remote closure and removal of the flexible bag 11 are illustrated in FIGS. 3-7. To close the bag, the user pulls on the drawstring 14 that is accessible through the groove in the side pocket 17 away from the solid container 18. The pulling by the user initially removes the sides of the bag 11 off the open top of a solid container 18, and then draw in the opening of the bag 11 causing it to be reduced to a minimum. Further pulling on the drawstring 14 by the user draws the bag opening into a closed mouth which then presses against the tab 13, which is preferably made of an elastic material, such that it seals the closed mouth of the bag 11 as shown in FIG. 4. The user would then pull the drawstring 14 out of the groove and carry the bag 11 by the drawstring 14 away for disposal as shown in FIG. 5. The user may pull more forcefully on the drawstring 14 causing the tab 13 to flex over the bag opening for improved sealing of the bag opening as shown in FIGS. 6 and 7.

The tab 13 is preferably made of a strong yet flexible and bendable plastic and as the drawn-in opening of the bag 11 is pulled onto the tab 13, the tab 13 forms a dome over the drawn-in opening of the bag 11 that prevents any unpleasant odors, germs or other hazardous gases from escaping out of the bag 11. Thus, while pulling on the drawstring 14 and drawing in the opening of the bag 11 substantially closes the bag 11, the tab 13 forms an additional barrier over the mouth of the bag 11 and keeps any biohazardous gases that may have formed inside the bag 11 to be contained inside the bag 11. The preferred shape of the tab 13 is circular; however, other tab shapes, including, but not limited to square, rectangular, and multi-sided also fall within the scope of the present invention.

The drawstring 14 is preferably made of elastic yet strong material as it must fit tightly over the open top of a solid container 18 and withstand the pulling forces exerted by the user to draw in the bag opening.

It should be understood, of course, that the foregoing relates to exemplary embodiments of the invention and that modifications may be made without departing from the spirit and scope of the invention.

The invention claimed is:

1. A containment device for isolating waste comprising:

a flexible bag having an opening;

a drawstring having a first end and a second end, said drawstring looping inside a channel formed around the opening of the flexible bag; and a tab having an inner surface, an outer surface and a center opening through which the first end and the second end of the drawstring are threaded, said first end of said drawstring being joined with the second end of the drawstring wherein an attachment formed by joining the first end of said drawstring with the second end of the drawstring is disposed behind the outer surface of the tab, said tab being configured for sliding on the drawstring in a direction toward the flexible bag or away from the flexible bag, wherein the opening of the flexible bag being configured for substantially contracting into a closed position and forming a closed mouth upon outwardly extending the drawstring while holding the tab is in a fixed position, said tab being adapted for flexing onto and sealing the closed mouth and wherein the flexible bag lines an inside of a solid container and the tab of the flexible bag is wedged in an immobile position in a pocket attached to the container.

2. The containment device for isolating waste of claim 1 wherein the tab is elastic and has a circular shape.

3. A method for isolating waste, said method comprising;

providing a flexible bag having an opening; a drawstring having a first end and a second end, said drawstring looping inside a channel formed around the opening; and a tab having an inner surface, an outer surface and a center opening through which the first end and the second end of the drawstring are threaded, said first end of said drawstring being joined with the second end of the drawstring wherein a combined end formed by joining the first end of said drawstring with the second end of the drawstring is disposed behind the outer surface of the tab, said tab being configured for sliding on the drawstring in a direction toward the flexible bag and away from the flexible bag;

providing a container, said container being held in a fixed position, said container comprising an inside, an open top and a slotted pocket attached to the container;

wedging the tab into the slotted pocket attached to the container such that the combined end of the drawstring is accessible through a groove in a rear of the slotted pocket and such that the tab is immobile;

stretching the opening of the flexible bag over the open top of the container and lining the flexible bag on the inside of the container;

placing waste that requires disposal inside the flexible bag;

pulling on the combined end of the drawstring away from the container and flexible bag, the pulling simultaneously causing the opening of the flexible bag to a) be removed off the open top of the container, b) to contract and form a closed mouth and c) to move the closed mouth toward the tab causing the tab to seal the closed mouth; and removing the drawstring and tab from the groove in a rear of the slotted pocket and removing the bag.

4. The method of isolating waste of claim 3 further comprising disposing of the flexible bag containing the waste.

* * * * *